US011718808B2

(12) United States Patent
Sakai

(10) Patent No.: US 11,718,808 B2
(45) Date of Patent: Aug. 8, 2023

(54) LUBRICANT COMPOSITION

(71) Applicant: NOK KLUEBER CO., LTD., Tokyo (JP)

(72) Inventor: Ayumi Sakai, Ibaraki (JP)

(73) Assignee: NOK KLUEBER CO., LTD., Tokyo (JP)

( * ) Notice: Subject to any disclaimer, the term of this patent is extended or adjusted under 35 U.S.C. 154(b) by 0 days.

(21) Appl. No.: 17/621,287

(22) PCT Filed: Jun. 17, 2020

(86) PCT No.: PCT/JP2020/023753
§ 371 (c)(1),
(2) Date: Dec. 21, 2021

(87) PCT Pub. No.: WO2020/262141
PCT Pub. Date: Dec. 30, 2020

(65) Prior Publication Data

US 2022/0356411 A1 Nov. 10, 2022

(30) Foreign Application Priority Data

Jun. 26, 2019 (JP) ..... 2019-118368

(51) Int. Cl.

| | |
|---|---|
| ***C10M 169/04*** | (2006.01) |
| ***C10M 107/38*** | (2006.01) |
| ***C10M 133/42*** | (2006.01) |
| ***C10M 147/04*** | (2006.01) |
| *C10N 30/00* | (2006.01) |
| *C10N 20/06* | (2006.01) |

(52) U.S. Cl.
CPC ..... *C10M 107/38* (2013.01); *C10M 133/42* (2013.01); *C10M 147/04* (2013.01); *C10M 169/044* (2013.01); *C10M 2213/0606* (2013.01); *C10M 2213/0626* (2013.01); *C10M 2215/222* (2013.01); *C10N 2020/06* (2013.01); *C10N 2030/76* (2020.05)

(58) Field of Classification Search
CPC ..... C10M 107/38; C10M 133/42; C10M 147/04; C10M 169/044; C10M 2213/0606; C10M 2213/0626; C10M 2215/222; C10M 169/02; C10N 2020/06; C10N 2030/76
See application file for complete search history.

(56) References Cited

U.S. PATENT DOCUMENTS

| | | | | |
|---|---|---|---|---|
| 4,682,025 | A | 7/1987 | Livingston et al. | |
| 5,510,059 | A | 4/1996 | Yuki et al. | |
| 2003/0195125 | A1 | 10/2003 | Akiyama | |
| 2004/0081380 | A1 | 4/2004 | Katagiri et al. | |
| 2010/0305012 | A1* | 12/2010 | Miyamoto | C10M 107/38 508/555 |
| 2011/0213069 | A1 | 9/2011 | Kanazawa et al. | |
| 2019/0024006 | A1 | 1/2019 | Yoshida et al. | |
| 2020/0115647 | A1 | 4/2020 | Ito | |

FOREIGN PATENT DOCUMENTS

| | | | | |
|---|---|---|---|---|
| EP | 1 878 785 | A1 | 1/2008 | |
| EP | 1878785 | A1 * | 1/2008 | C10M 169/02 |
| EP | 2 636 724 | A1 | 9/2013 | |
| EP | 1 878 785 | B1 | 4/2014 | |
| JP | S45-5595 | B | 2/1970 | |
| JP | S61-34430 | A | 2/1986 | |
| JP | H5-310716 | A | 11/1993 | |
| JP | H7-224049 | A | 8/1995 | |
| JP | 2002-097484 | A | 4/2002 | |
| JP | 2003-246996 | A | 9/2003 | |
| JP | 2003-293797 | A | 10/2003 | |
| JP | 2006-232921 | A | 9/2006 | |
| JP | 2009-91464 | A | 4/2009 | |
| JP | 4883920 | B | 2/2012 | |
| JP | 6218127 | B2 | 10/2017 | |
| WO | WO 2018/220945 | A1 | 12/2018 | |

OTHER PUBLICATIONS

WO/IPRP issued in International Patent Application No. PCT/JP2020/023753, dated Dec. 28, 2021, translation.
1st Office Action issued in CN Patent Application No. 202080041108.9, dated May 25, 2022, translation.
ISR for PCT/JP2020/023753, dated Sep. 8, 2020.
Notice of Reasons for Refusal issued in JP Patent Application No. 2021-526840, dated Oct. 18, 2022, translation.
Notice of Reasons for Refusal issued in CN Patent Application No. 202080041108.9, dated Nov. 2, 2022, translation.
EESR issued in EP Patent Application No. 20830579.7, Jun. 5, 2023.

* cited by examiner

*Primary Examiner* — Taiwo Oladapo
(74) *Attorney, Agent, or Firm* — Greenblum & Bernstein P.L.C.

(57) ABSTRACT

A lubricant composition for a resin-resin sliding portion or a resin-metal sliding portion that contains a base oil containing a perfluoropolyether oil including a side chain, and a polytetrafluoroethylene having a primary particle diameter of 1 μm or larger and a melamine cyanurate as thickeners.

3 Claims, No Drawings

LUBRICANT COMPOSITION

CROSS REFERENCE TO RELATED APPLICATIONS

The present application is a national stage application of International Patent Application No. PCT/JP2020/23753 filed on Jul. 17, 2020, which claims the benefit of Japanese Patent Application No. 2019-118368, filed on Jun. 26, 2019. The contents of these applications are incorporated herein by reference in their entirety.

TECHNICAL FIELD

The present disclosure relates to a lubricant composition for resin-resin sliding portions or resin-metal sliding portions which is excellent in the reduction effect of sounds generated at sliding portions.

BACKGROUND ART

Conventionally, lubricant compositions have been used for resin-resin sliding portions or resin-metal sliding portions for the purpose of improving friction and wear characteristics. Examples of the resin-resin sliding portion include flat cables and rotating parts of steering roll connectors. Conventional lubricant compositions, however, are used for the purpose of improving friction and wear characteristics, and there have not sufficiently been studied the reduction of sounds (hereinafter, described as "hammering sounds" in some cases) generated at a sliding portion when cables or a cable and a case strike.

Japanese Patent No. 4883920 discloses (claim 1, paragraph [0008]) a grease composition containing a perfluoropolyether oil as a base oil and a melamine cyanurate and polytetrafluoroethylene as thickeners.

Japanese Patent No. 6218127 discloses (claim 1) a lubricant composition for resin-resin sliding containing a base oil containing a perfluoropolyether oil having a straight-chain structure, and a melamine cyanurate.

SUMMARY OF DISCLOSURE

Technical Problem

The grease composition of Japanese Patent No. 4883920, however, is a grease composition for bearings, particularly rolling bearings, and has an object of having a long life span even at high temperatures, and the reduction of hammering sounds is not studied.

Then, the lubricant composition for resin-resin sliding of Japanese Patent No. 6218127 has an object of providing a lubricant composition capable of exhibiting the lubricating performance excellent in sliding of resin members (resin-resin), and has room for further improvement in reduction of hammering sounds.

The gist and constitution of the present disclosure are as follows.

[1] A lubricant composition for a resin-resin sliding portion or a resin-metal sliding portion, including:

a base oil including a perfluoropolyether oil including a side chain; and a polytetrafluoroethylene having a primary particle diameter of 1 μm or larger and a melamine cyanurate as thickeners.

[2] The lubricant composition according to the above [1], wherein the perfluoropolyether oil includes —$CF_3$ as the side chain.

[3] The lubricant composition according to the above [1] or [2], wherein the perfluoropolyether oil is at least one perfluoropolyether oil selected from the group consisting of perfluoropolyether oils represented by the following general formulae (1) to (3):

$$Rf^1O[CF(CF_3)CF_2O]_mRf^2 \quad (1)$$

wherein $Rf^1$ and $Rf^2$ each independently represent a perfluoroalkyl group having 1 to 5 carbon atoms; and m represents an integer of 2 to 200;

$$F(CF(CF_3)CF_2O)_nCF_2CF_3 \quad (2)$$

wherein n represents an integer of 10 to 60; and $$CF_3[(OCF(CF_3)CF_2)_o(OCF_2)_p]OCF_3 \quad (3)$$

wherein o+p represents an integer of 5 to 50.

[4] The lubricant composition according to any one of the above [1] to [3], wherein the content of the polytetrafluoroethylene in the lubricant composition is 1 to 50% by mass.

[5] The lubricant composition according to any one of the above [1] to [4], wherein the content of the melamine cyanurate in the lubricant composition is 3 to 25% by mass.

Effect of Disclosure

There can be provided a lubricant composition for resin-resin sliding portions or resin- metal sliding portions which is excellent in the reduction effect of sounds (hammering sounds) generated at sliding portions.

DESCRIPTION OF EMBODIMENT

A lubricant composition for a resin-resin sliding portion (sliding portion of resin members) or a resin-metal sliding portion (sliding portion of a resin member and a metal member) according to an embodiment contains a base oil containing a perfluoropolyether oil (PFPE) including a side chain, and a polytetrafluoroethylene having a primary particle diameter of 1 μm or larger and a melamine cyanurate as thickeners. The lubricant composition of the embodiment contains the perfluoropolyether oil including a side chain, and the polytetrafluoroethylene having a primary particle diameter of 1 μm or larger and the melamine cyanurate. By thus combining the perfluoropolyether oil including a side chain, which easily becomes high in viscosity under a pressure, with two kinds of thickeners having different affinities for the base oil, the lubricant composition exhibits good cushion characteristics due to their synergetic action, and can reduce hammering sounds. Then since the perfluoropolyether oil (PFPE) including a side chain, the polytetrafluoroethylene and the melamine cyanurate are chemically stable, also in the case of applying the lubricant composition on a resin-resin sliding portion and a resin-metal sliding portion, the lubricant composition never has adverse influences such as deterioration on materials forming these sliding portions.

Hereinafter, each component forming the lubricant composition of the embodiment will be described.

(Base Oil)

A base oil to be used for the lubricant composition of the embodiment contains a perfluoropolyether oil including a side chain. The perfluoropolyether oil including a side chain may be used singly or as a mixture of a plurality of kinds thereof.

The kinematic viscosity at 40° C. of the base oil is preferably 10 to 2,000 $mm^2/s$ more preferably 15 to 1,300 $mm^2/s$, still more preferably 60 to 420 $mm^2/s$. Here, the kinematic viscosity at 40° C. of the base oil can be measured according to JIS K2283. When the kinematic viscosity at 40° C. of the base oil is in these ranges, the handleability of the lubricant composition can be improved.

The perfluoropolyether oil including a side chain is not especially limited as long as being one in which all hydrogen atoms bonded to carbon atoms are substituted by fluorine atoms and which includes a side chain and a polyether structure. Here, "side chain" represents a group branched from the main chain, which is the longest carbon chain, and having one or more carbon atoms. The perfluoropolyether oil may include a side chain(s) on one place or on a plurality of places of the main chain. Typically, the perfluoropolyether oil includes a divalent group represented by $—C_aF_{2a}O—$ (a is an integer) as an ether group in the main chain. Examples of the divalent group include $—CF_2O—$, $—C_2F_4O—$, and $—C_3F_6O—$. The perfluoropolyether oil can include —O—, $—C_bF_{2b}—$ (b is an integer) and other divalent groups in the main chain. A side chain(s) may be bonded to one carbon atom or a plurality of carbon atoms of the above divalent ether group, and a side chain(s) may be bonded to an end portion(s) of the main chain. End groups of the main chain of the perfluoropolyether oil including a side chain are not especially limited as long as being end groups in which all hydrogen atoms bonded to carbon atoms are substituted by fluorine atoms, but include $—OC_cF_{2c+1}$ and $—C_cF_{2c+1}$ (c is an integer). It is preferable that the perfluoropolyether oil contains $—C_dF_{2d+1}$ (d is an integer of 1 to 5) as the side chain; and the side chain includes a perfluoromethyl group, a perfluoroethyl group, a perfluoropropyl group, a perfluorobutyl group and a perfluoropentyl group. Among these side chains, a perfluoromethyl group and a perfluoroethyl group are preferable; and a perfluoromethyl group ($—CF_3$) is more preferable.

It is more preferable that the perfluoropolyether oil including a side chain is at least one perfluoropolyether oil selected from the group consisting of perfluoropolyether oils represented by the following general formulae (1) to (3):

$$Rf^1O[CF(CF_3)CF_2O]_mRf^2 \quad (1)$$

wherein in the above general formula (1), $Rf^1$ and $Rf^2$ each independently represent a perfluoroalkyl group having 1 to 5 carbon atoms; and m represents an integer of 2 to 200;

$$F(CF(CF_3)CF_2O)_nCF_2CF_3 \quad (2)$$

wherein in the above general formula (2), n represents an integer of 10 to 60; and $$CF_3[(OCF(CF_3)CF_2)_o(OCF_2)_p]OCF_3 \quad (3)$$

wherein in the above general formula (3), o+p represents an integer of 5 to 50.

By using the perfluoropolyether oils including a side chain represented by the above general formulae (1) to (3), the lubricant composition can have a better reduction effect of hammering sounds.

The perfluoropolyether oil including a side chain can be obtained, for example, by anionically polymerizing hexafluoropropylene oxide and the like with a fluoride ion donor such as cesium fluoride as a catalyst, and then processing the obtained acid fluoride compound including terminal —CFXCOF group with fluorine gas.

The base oil can contain other oily components in addition to the perfluoropolyether oil including a side chain, and can contain, for example, a perfluoropolyether oil including no side chain (including a straight-chain structure). The perfluoropolyether oil including a straight-chain structure is not especially limited, and for example, it is possible to use at least one perfluoropolyether oil (PFPE) selected from the group consisting of perfluoropolyether oils represented by the following general formulae (4) to (6):

$$F(CF_2CF_2CF_2O)_qCF_2CF_3 \quad (4)$$

wherein in the above general formula (4), q represents an integer of 2 to 200;

$$Rf^3O[CF_2CF_2O]_rRf^4 \quad (5)$$

wherein in the above general formula (5), r represents the number of 2 to 200; and $Rf^3$ and $Rf^4$ each independently represent a perfluoroalkyl group having 1 to 5 carbon atoms; and $$Rf^5O(CF_2CF_2O)_s(CF_2O)_tRf^6 \quad (6)$$

wherein in the above general formula (6), s and t represent numbers satisfying s+t=3 to 200; and $Rf^5$ and $Rf^6$ each independently represent a perfluoroalkyl group having 1 to 5 carbon atoms.

The lubricant composition of the embodiment can contain, as base oils, oily components other than the perfluoropolyether oil in the range of not impairing the object of the present disclosure. The oily components concurrently usable with the perfluoropolyether oil include at least one synthetic oil selected from the group consisting of synthetic hydrocarbon oils, ester-based synthetic oils, ether-based synthetic oils and glycol-based synthetic oils. As the synthetic hydrocarbon oil, for example, at least one synthetic hydrocarbon oil selected from poly-α-olefin, ethylene-α-olefin copolymers, polybutene, alkylbenzenes, alkylnaphthalenes and the like can be used. As the ester-based synthetic oil, for example, at least one ester-based synthetic oil selected from esters such as diesters, polyol esters and aromatic esters, or a mixture of two or more thereof can be used. As the ether-based synthetic oil, for example, at least one ether-based synthetic oil selected from alkyldiphenyl ethers and the like can be used. As the glycol-based synthetic oil, at least one glycol-based synthetic oil selected from polyethylene glycol, polypropylene glycol and the like can be used.

The content of the base oil in the lubricant composition of the embodiment is preferably 40 to 90% by mass, more preferably 50 to 85% by mass, still more preferably 55 to 80% by mass. When the content of the base oil is in these ranges, the lubricant composition can simultaneously have both an excellent hammering sound reduction effect and lubricating performance. Then in the case where the lubricant composition contains the oily components other than the perfluoropolyether oil including a side chain as the base oils, the content of the perfluoropolyether oil including a side chain in 100 parts by mass of the base oils is preferably 10 parts by mass or higher, more preferably 30 parts by mass or higher, still more preferably 40 parts by mass or higher. When the content of the perfluoropolyether oil including a side chain is in the above range, the lubricant composition can have a better reduction effect of hammering sounds.

(Thickener)

The lubricant composition of the embodiment contains a polytetrafluoroethylene having a primary particle diameter of 1 μm or larger, and a melamine cyanurate as thickeners. As the polytetrafluoroethylene (PTFE), for example, PTFE obtained by a method of emulsion polymerization, suspension polymerization, solution polymerization of tetrafluoroethylene can be used. The primary particle diameter of the polytetrafluoroethylene is 1 μm or larger, preferably 1 to 100

μm, more preferably 1 to 30 μm. When the primary particle diameter of the polytetrafluoroethylene is 1 μm or larger, there is enhanced the cushion characteristics exhibited when two kinds of thickeners having different affinities for the base oil are combined, and the reduction effect of hammering sounds can be more improved. Here, the primary particle diameter of the polytetrafluoroethylene can be measured by taking a photograph of polytetrafluoroethylene particles by an electron microscope and thereafter image analyzing the photograph. Then, a commercially available polytetrafluoroethylene can be used. Examples of the commercially available polytetrafluoroethylene include MP-1300-J (manufactured by Du Pont Mitsui Fluorochem Co., Ltd.), KTL-8N, KTL-20N (both manufactured by Kitamura Ltd.), Cefral Lube(R) I (manufactured by Central Glass Co., Ltd.), TF9025 (manufactured by 3M Co.) and Fluoro GS 125, Fluoro GT 130 (both manufactured by Shamrock Technologies, Inc.).

The content of the polytetrafluoroethylene in the lubricant composition of the embodiment is preferably 1 to 50% by mass, more preferably 10 to 40% by mass, still more preferably 15 to 35% by mass. When the content of the polytetrafluoroethylene is in the above range, the lubricant composition can have an excellent reduction effect of hammering sounds.

The melamine cyanurate is not especially limited, and well-known melamine cyanurates can be sued. Specifically, there can suitably be used melamine cyanurates described in Japanese Patent Publication No. Show 45-5595, Japanese Patent Publication No. Show 61-34430, Japanese Patent Laid-Open No. Hei 05-310716, Japanese Patent Laid-Open No. Hei 07-224049 and the like. Then commercially available melamine cyanurates include MCA-1 (manufactured by Mitsubishi Chemical Corp.) and MC-4000, MC-6000, MC-8100 (all, manufactured by Nissan Chemical Industries, Ltd.).

The content of the melamine cyanurate in the lubricant composition of the embodiment is preferably 3 to 25% by mass, more preferably 3 to 20% by mass, still more preferably 3 to 10% by mass. When the content of the melamine cyanurate is 3% by mass or higher, the lubricant composition can have an excellent reduction effect of hammering sounds. When the content of the melamine cyanurate is 25% by mass or lower, the lubricant composition can have a suitable worked penetration.

The mass ratio between the polytetrafluoroethylene and the melamine cyanurate in the lubricant composition is preferably 30:70 to 90:10, more preferably 60:40 to 90:10.

The lubricant composition of the embodiment can contain thickeners other than the polytetrafluoroethylene and the melamine cyanurate in the range of not impairing the object of the present disclosure. Examples of such a thickener include metal soap-based thickeners, carbon black, Aerosil, Bentone, terephthalamates, urea and phthalocyanine.

(Other Components)

The lubricant composition according to the embodiment can contain other additives in the range of not exerting an influence on the advantageous effect of the present disclosure. For example, the lubricant composition can contain a suitably selected well-known antioxidant, extreme-pressure agent, rust preventive, corrosion inhibitor, viscosity index improver or the like.

Examples of the antioxidant include phenolic antioxidants such as 2,6-di-tert-butyl-4-methylphenol and 4,4'-methylenebis(2,6-di-tert-butylphenol), amine-based antioxidants such as alkyldiphenylamines, triphenylamine, phenyl-α-naphthylamine, phenothiazine, alkylated phenyl-α-naphthylamines and alkylated phenothiazines, and additionally, phosphoric acid-based antioxidants and sulfur-based antioxidants.

Examples of the extreme-pressure agent include phosphorus-based compounds such as phosphate esters, phosphite esters and phosphate ester amine salts, sulfur compounds such as sulfides and disulfides, sulfur-based metal salts such as dialkyldithiophosphoric acid metal salts and dialkyldithiocarbamic acid metal salts, and chlorine compounds such as chlorinated paraffins and chlorinated diphenyls.

Examples of the rust preventive include fatty acids, fatty acid amines, metal sulfonates, alkylsulfonic acid metal salts, alkylsulfonic acid amine salts, oxidized paraffins, and polyoxyethylene alkyl ethers.

Examples of the corrosion inhibitor include benzotriazole, benzoimidazole, thiadiazole and sodium cebacate.

Examples of the viscosity index improver include polymethacrylates, ethylene-propylene copolymers, polyisobutylene, polyalkylstyrenes, and hydrogenated styrene-isoprene copolymers.

(Sliding Portion)

The lubricant composition of the embodiment is used by being applied or otherwise on a resin-resin sliding portion (sliding portion of resin members) or a resin-metal sliding portion (sliding portion of a resin member and a metal member). The resin material forming the resin-resin sliding portion and the resin-metal sliding portion is not especially limited, but examples thereof include polyethylene (PE), polypropylene (PP), ABS resins (ABS), polyacetal (POM), nylon (PA), polycarbonate (PC), phenol resins (PF), polyethylene terephthalate (PET), polybutylene terephthalate (PBT), polyphenylene sulfide (PPS), polyether sulfone (PES), polyimide (PI), and polyetheretherketone (PEEK). The metal material forming the resin-metal sliding portion is not especially limited, and a suitable metal material can be appropriately selected according to the application and the purpose of the sliding portion.

The lubricant composition can be used for resin-resin sliding portions or resin-metal sliding portions of various types of mechanical parts forming, for example, automobiles, machines, electric and electronic devices and the like. More specifically, the lubricant composition can broadly be used for parts of business devices such as copying machines and printers, parts of power transmission apparatuses such as speed reducing gears and speed increasing gears, gears, chains and motors, parts of running systems, parts of control systems for ABS and the like, parts of steering systems, parts of driving systems such as transmissions, automotive parts of steering devices, power window motors, power seat motors, sunroof motors and the like, hinge parts of electronic information equipment, cell phones and the like, and various types of parts and mechanical parts moving relatively in food and pharmaceutical industries, steel, building and in chemical, rubber and resin industries including glass industries, cement industries and film tenters, environment and power facilities, and paper making and printing industries, wood industries, and textile and apparel industries. Suitably, the lubricant composition can be used for a sliding portion of a clockspring rotary connector assembled in a steering system of an automobile.

EXAMPLES

Hereinafter, preferred embodiments of the present disclosure will be described specifically based on Examples and Comparative Examples, but the present disclosure is not any more limited to these Examples.

Lubricant compositions were each prepared by mixing a base oil(s) and thickeners described below and then kneading the resultant mixture sufficiently by a three-roll mill or a high-pressure homogenizer so as to make blend amounts (% by mass) indicated in Examples 1 to 9 and Comparative Examples 1 to 5 in Table 1 and Table 2.

<Base Oil>

Base oil 1: product name: "Barrierta(R) J25 FLUID" (manufactured by NOK Klüber Co., Ltd., kinematic viscosity at 40° C.: 25 $mm^2/s$), a perfluoropolyether oil including a side chain $RfO[CF(CF_3)CF_2O]_mRf$ Base oil 2: product name: "Barrierta(R) J130 FLUID" (manufactured by NOK Klüber Co., Ltd., kinematic viscosity at 40° C.: 130 $mm^2/s$), a perfluoropolyether oil including a side chain $RfO[CF(CF_3)CF_2O]_mRf$ Base oil 3: product name: "Fomblin(R) YR1500" (manufactured by Solvay Specialty Polymers K.K., kinematic viscosity at 40° C.: 420 $mm^2/s$), a perfluoropolyether oil including a side chain $CF_3[(OCF(CF_3)CF_2)_o(OCF_2)_p]OCF_3$ Base oil 4: product name: "Fomblin(R) M03" (manufactured by Solvay Specialty Polymers K.K., kinematic viscosity at 40° C.: 17 $mm^2/s$), a perfluoropolyether oil including no side chain (including a straight-chain structure) $RfO(CF_2CF_2O)_s(CF_2O)_tRf$ Base oil 5: product name: "Fomblin(R) M15" (manufactured by Solvay Specialty Polymers K.K., kinematic viscosity at 40° C.: 85 $mm^2/s$), a perfluoropolyether oil including no side chain (including a straight-chain structure) $RfO(CF_2CF_2O)_s(CF_2O)_tRf$ Base oil 6: product name: "Fomblin(R) M30" (manufactured by Solvay Specialty Polymers K.K., kinematic viscosity at 40° C.: 159 $mm^2/s$), a perfluoropolyether oil including no side chain (including a straight-chain structure) $RfO(CF_2CF_2O)_s(CF_2O)_tRf$ Base oil 7: product name: "Demnum(R) S200" (manufactured by Daikin Industries, Ltd., kinematic viscosity at 40° C.: 200 $mm^2/s$), a perfluoropolyether oil including no side chain (including a straight-chain structure) $F(CF_2CF_2CF_2O)_qCF_2CF_3$ <Thickener>

Melamine cyanurate: product name: "MC-6000" (manufactured by Nissan Chemical Industries, Ltd.), average particle diameter $d_{50}$: 2 μm Polytetrafluoroethylene: product name: "Lubron(R) L-2" (manufactured by Daikin Industries, Ltd.), primary particle diameter ϕ: about 0.2 μm Polytetrafluoroethylene: product name: "Fluoro GS 100" (manufactured by Shamrock Technologies, Inc.), primary particle diameter ϕ: about 4 μm Obtained lubricant compositions were evaluated by the following method Hammering sound reduction characteristic: About 720 mg of a lubricant composition was applied on one sliding portion in a steering roll connector built in a commercially available automobile, and the steering roll connector was manually rotated at a rate of 60 rpm at room temperature. At this time, the presence or absence of hammering sounds was inspected by whether or not a person standing at a position 0.05 m away from the steering roll connector was able to catch hammering sounds from the steering roll connector. In the following Table 1 and Table 2, no generation of hammering sounds is indicated as "○"; and generation of hammering sounds is indicated as "X".

TABLE 1

| | Example 1 | Example 2 | Example 3 | Example 4 | Example 5 | Example 6 | Example 7 | Example 8 | Example 9 |
|---|---|---|---|---|---|---|---|---|---|
| Base oil 1 | 64 | | | | | | | | |
| Base oil 2 | | 55 | | 58 | 55 | 50 | 44 | 25 | 40 |
| Base oil 3 | | | 73 | | | | | | |
| Base oil 4 | | | | 6 | 10 | 22 | | | |
| Base oil 5 | | | | | | | | | 30 |
| Base oil 6 | | | | | | | 28 | | |
| Base oil 7 | | | | | | | | 35 | |
| Polytetrafluoroethylene: product name: "Fluoro GS 100", (manufactured by Shamrock Technologies, Inc.), primary particle diameter φ: about 4 μm | 32 | 40 | 22 | 32 | 25 | 20 | 20 | 35 | 10 |
| Melamine cyanurate | 4 | 5 | 5 | 4 | 10 | 8 | 8 | 5 | 20 |
| Total amount | 100 | 100 | 100 | 100 | 100 | 100 | 100 | 100 | 100 |
| Hammering sound reduction characteristic | ○ | ○ | ○ | ○ | ○ | ○ | ○ | ○ | ○ |

TABLE 2

| | Comparative Example 1 | Comparative Example 2 | Comparative Example 3 | Comparative Example 4 | Comparative Example 5 |
|---|---|---|---|---|---|
| Base oil 1 | | | | | |
| Base oil 2 | 55 | | | | 44 |
| Base oil 3 | | | | 85 | |
| Base oil 4 | | | | | |
| Base oil 5 | | | | | 30 |
| Base oil 6 | | | 55 | | |
| Base oil 7 | | 88 | | | |

TABLE 2-continued

| | Comparative Example 1 | Comparative Example 2 | Comparative Example 3 | Comparative Example 4 | Comparative Example 5 |
|---|---|---|---|---|---|
| Polytetrafluoroethylene: product name: "Lubron L-2", (manufactured by Daikin Industries, Ltd.), primary particle diameter φ: about 0.2 μm | | | | | 21 |
| Polytetrafluoroethylene: product name: "Fluoro GS 100", (manufactured by Shamrock Technologies, Inc.), primary particle diameter φ: about 4 μm | 45 | | 40 | | |
| Melamine cyanurate | | 12 | 5 | 15 | 5 |
| Total amount | 100 | 100 | 100 | 100 | 100 |
| Hammering sound reduction characteristic | x | x | x | x | x |

From Table 1, it is clear that Examples 1 to 9 each had excellent hammering sound reduction characteristic since used were lubricant compositions which include a base oil containing a perfluoropolyether oil including a side chain, and a polytetrafluoroethylene having a primary particle diameter of 1 μm or larger and a melamine cyanurate as thickeners.

By contrast, the lubricant composition of Comparative Example 1, since containing no melamine cyanurate, and the lubricant composition of Comparative Example 2, since containing no perfluoropolyether oil including a side chain and no polytetrafluoroethylene, were poor in the hammering sound reduction characteristic. The lubricant composition of Comparative Example 3, since containing no perfluoropolyether oil including a side chain, and the lubricant composition of Comparative Example 4, since containing no polytetrafluoroethylene, were poor in the hammering sound reduction characteristic. Then the lubricant composition of Comparative Example 5, since the primary particle diameter of the polytetrafluoroethylene was smaller than 1.0 μm, was poor in the hammering sound reduction characteristic.

The invention claimed is:

1. A lubricant composition for a resin-resin sliding portion or a resin-metal sliding portion, comprising:

a base oil comprising a perfluoropolyether oil including a side chain; and a polytetrafluoroethylene having a primary particle diameter of 1 μm or larger and a melamine cyanurate as thickeners, wherein a content of the polytetrafluoroethylene in the lubricant composition is 10 to 40% by mass, and a content of the melamine cyanurate in the lubricant composition is 4 to 20% by mass.

2. The lubricant composition according to claim 1, wherein the perfluoropolyether oil comprises —$CF_3$ as the side chain.

3. The lubricant composition according to claim 1, wherein the perfluoropolyether oil is at least one perfluoropolyether oil selected from the group consisting of perfluoropolyether oils represented by the following general formulae (1) to (3):

$$Rf^1O[CF(CF_3)CF_2O]_mRf^2 \quad (1)$$

wherein $Rf^1$ and $Rf^2$ each independently represent a perfluoroalkyl group having 1 to 5 carbon atoms; and m represents an integer of 2 to 200;

$$F(CF(CF_3)CF_2O)_nCF_2CF_3 \quad (2)$$

wherein n represents an integer of 10 to 60; and $$CF_3[OCF(CF_3)CF_2)_o(OCF_2)_p]OCF_3 \quad (3)$$

wherein o+p represents an integer of 5 to 50.

* * * * *